US006427399B1

(12) United States Patent
Ross et al.

(10) Patent No.: US 6,427,399 B1
(45) Date of Patent: Aug. 6, 2002

(54) BLOCK WINDOW SYSTEM WITH BORDER FRAME

(75) Inventors: Samuel Ross; Charlene Crooks, both of Vienna, WV (US); Karl Hatrak, Thousand Palms, CA (US)

(73) Assignee: Hy-Lite Products, Inc., Parkersburg, WV (US)

( * ) Notice: Subject to any disclaimer, the term of this patent is extended or adjusted under 35 U.S.C. 154(b) by 0 days.

(21) Appl. No.: 09/581,930

(22) PCT Filed: Oct. 26, 1999

(86) PCT No.: PCT/US99/24212

§ 371 (c)(1),
(2), (4) Date: Jun. 19, 2000

(87) PCT Pub. No.: WO00/24983

PCT Pub. Date: May 4, 2000

Related U.S. Application Data

(60) Provisional application No. 60/105,605, filed on Oct. 26, 1998.

(51) Int. Cl.[7] ..... E06B 3/988

(52) U.S. Cl. ..... 52/204.7; 52/306; 52/308; 52/204.71; 52/204.62

(58) Field of Search ..... 52/306–308, 204.53, 52/204.7, 204.58, 204.71, 207, 775, 780, DIG. 17

(56) References Cited

U.S. PATENT DOCUMENTS

| | | | | | |
|---|---|---|---|---|---|
| 4,891,925 | A | * | 1/1990 | Carlsone et al. | 52/585 |
| 5,042,210 | A | * | 8/1991 | Taylor | 52/307 |
| 5,218,806 | A | * | 6/1993 | Taylor | 52/410 |
| 5,448,864 | A | * | 9/1995 | Rosamond | 52/307 |
| 5,595,033 | A | * | 1/1997 | Frey | 52/306 |
| 5,687,521 | A | | 11/1997 | Carlson et al. | |
| 5,740,646 | A | * | 4/1998 | Wirkus et al. | 52/308 |
| 5,791,102 | A | * | 8/1998 | Sheath et al. | 52/204.7 |
| 5,860,260 | A | * | 1/1999 | Hase | 52/307 |
| 5,904,018 | A | * | 5/1999 | Campagnari | 52/306 |

* cited by examiner

*Primary Examiner*—Carl D. Friedman
*Assistant Examiner*—Yvonne M. Horton
(74) *Attorney, Agent, or Firm*—Cesari and McKenna, LLP

(57) ABSTRACT

A block window system includes an array of glass or acrylic blocks, a window frame and a variable-dimensioned border frame that positions the array within the window frame. The border frame includes a body that has a first end that is shaped to mate with the array of blocks, and a second end that mates with the window frame, which is a desired size or is sized to fit in a given opening. The height or width of any or all of the sides, the top and the bottom sections of the border frame are adjusted by selecting the length of the body of the corresponding section of the border frame, such that the border frame extends between the interior dimensions of the window frame and the exterior dimensions of the array.

25 Claims, 7 Drawing Sheets

BLOCK WINDOW SYSTEM WITH BORDER FRAME

This application is a 271 of PCT/US99/24212 filed Oct. 26, 1999 which claims the benefit of Provisional Application 60/105,605 filed Oct. 26, 1998.

FIELD OF INVENTION

The invention relates generally to block window systems and, more particularly, to block window systems of selectable sizes.

BACKGROUND OF THE INVENTION

Arrays of glass or acrylic blocks may be used instead of sheet glass in new construction and replacement window systems. It is generally too costly to manufacture blocks of varying sizes. Accordingly, known prior block window systems are sized to the dimensions of arrays of standard 6 inch or 8 inch blocks. The limited number of sizes for the block window systems may prohibit their use in certain buildings or in certain locations within a building, or as replacement windows.

In new construction, for example, the sizes of the window systems are selected to give the building a desired appearance. The block window systems may then be used, if the selected sizes match one of the limited sizes of the available block window systems. Otherwise, prior to the invention, the block window systems could not be used for the construction.

In existing construction, replacement window systems must be sized to fit into the dimensions of the rough opening that is left after removal of the old window systems. If sheet glass is used, the window frame and glass are, as necessary, custom sized to fit in the opening. Prior to the invention, block window systems could not be used as replacement systems in openings with dimensions that varied from those associated with the arrays of the standard-sized blocks without cutting the blocks.

SUMMARY OF THE INVENTION

The invention is a block window system that includes a variable-dimensioned border frame. The border frame is shaped at a first end to mate with the array of blocks, and at a second end to mate with a window frame that is a desired size or is sized to fit in a given opening. The height or width of any or all of the sides, the top and the bottom of the border frame are adjusted such that the border frame fits into the dimensions of the window frame and positions the array of standard-sized blocks therein.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
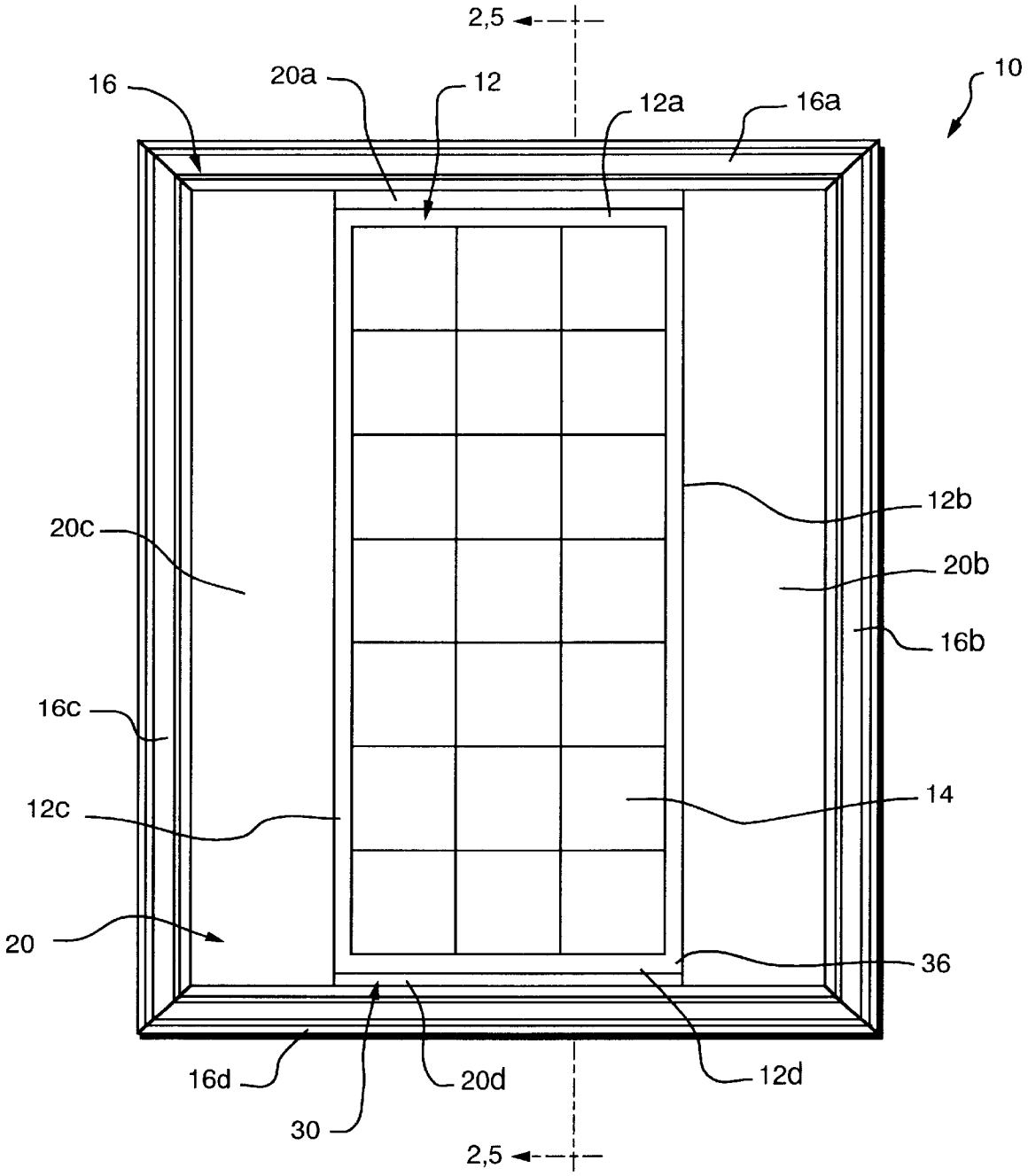
FIG. 1 depicts a window system that is constructed in accordance with the invention and inludes a variable-dimensioned border frame.

Referring now to FIG. 1, a window system 10 includes an array 12 of inter-connected standard-sized blocks 14 that is surrounded by a variable-dimensioned border frame 20. The top, bottom and sides sections 20*a*–20*d* of the border frame 20 extend between top, side and bottom walls 12*a*–12*d* of the array 12 and the corresponding top, side and bottom sections 16*a*–*d* of a window frame 16, to position the array 12 within the window frame 16. The window system 10 is a desired size for new construction or is sized to the dimensions of a rough opening (not shown) into which the system is to be installed as a replacement window system. The array 12 has dimensions that are dictated by the size of the included blocks 14, and the border frame 20 is dimensioned to position the array 12 within the window frame 16. The manner in which the border frame 20 connects to the array 12 at a first end and to the frame 16 at a second end is discussed in more detail below with reference to FIGS. 2–8.

The border frame 20 may be made of various materials, such as vinyl or aluminum, and may be shaped in various alternative configurations as discussed below. The border frame is described below in relation to blocks that are discussed in U.S. Pat. No. 4,891,925, which is hereby incorporated herein by reference. The border frame may, however, be configured to connect to other blocks, that is, to blocks that have alternative inter-connection mechanisms.

Figure 2:
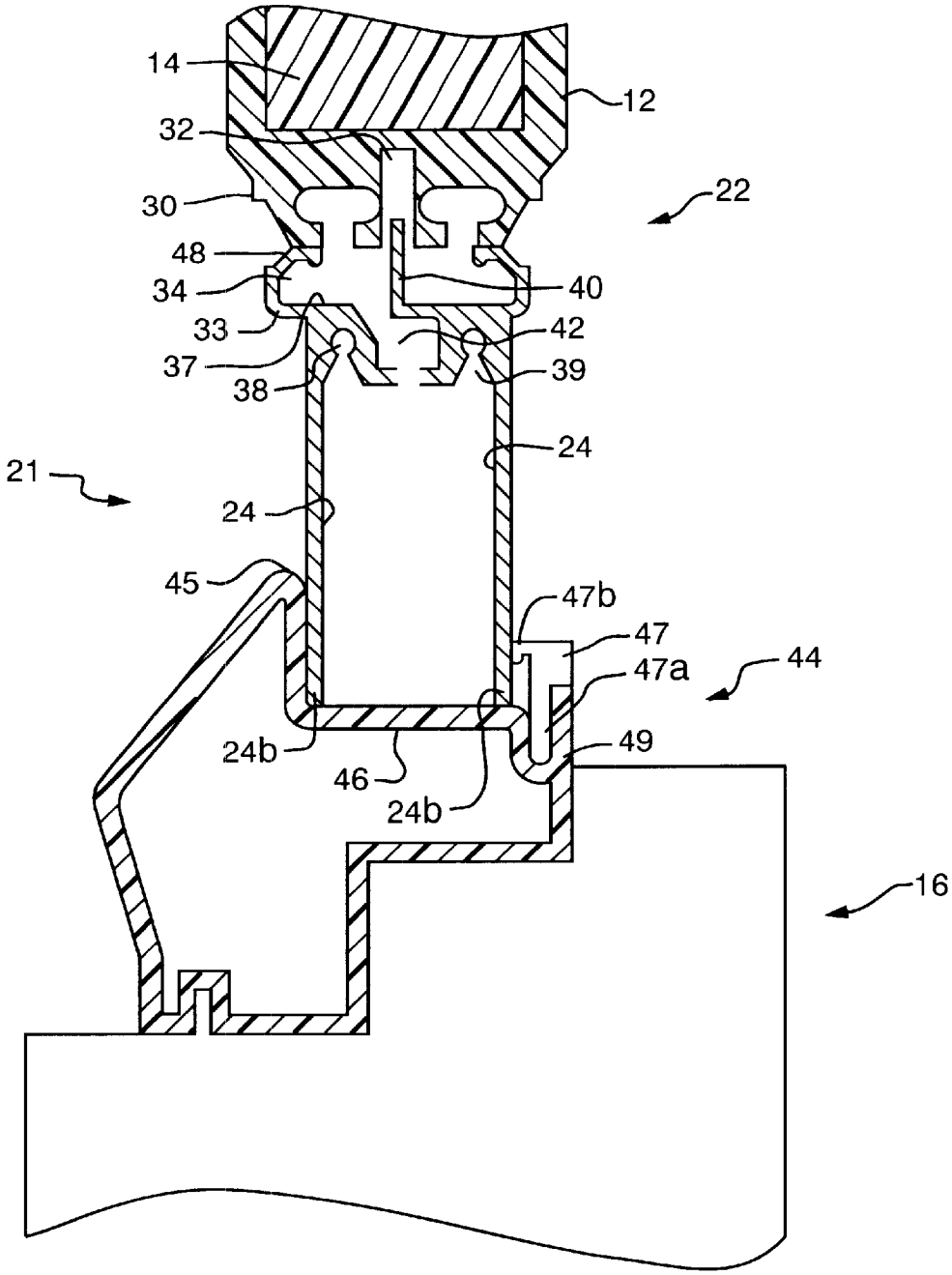
FIG. 2 is a side cut-away view of the window system through line A—A of FIG.

FIG. 2 depicts a cut-away view through line A—A of FIG. 1 of a first configuration 21 of the border frame 20. This configuration includes a first end 22 that is shaped to mate with channels 30 that extend outwardly from the walls of the array 12 of blocks 14. The channels 30 are also used to interconnect the blocks 14, as discussed in the incorporated patent.

Figure 3:
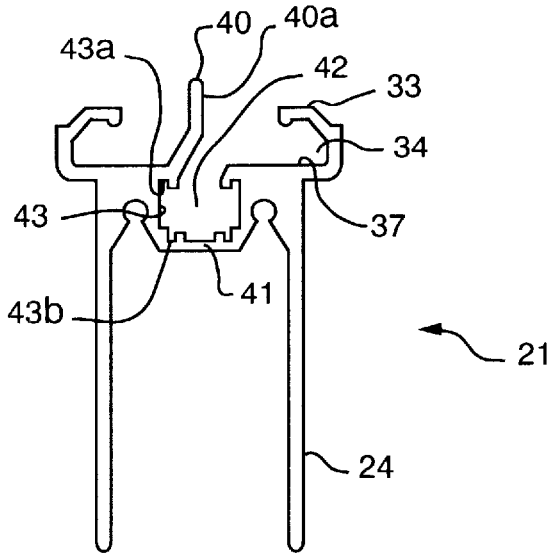
FIG. 3 depicts a section of a border frame of FIG. 2 before assembly.

Referring now also to FIG. 3, the first end 22, which is somewhat similar in shape to a connector that is discussed in U.S. Pat. No. 5,687,521, includes two webs 34 that meet the two channels 30. One of the webs 34 includes an elongated alignment projection 40 that at one end 40*a* fits within a gap 32 between the channels 30. The projection positions the array 12 properly within the border frame 20.

The border frame 20 also includes outwardly extending legs 24 that together form a second end 26 that essentially extends the array 12 to and positions the array in the window frame 16. The lengths of the legs 24 for the top, bottom and side sections of the border frame correspond to the differences between the exterior dimensions of the array 12 and interior dimensions of the window frame 16.

Clips (not shown) attach between the channels 30 on the blocks 14 and the webs 34, to fasten the border frame 20 to the blocks 14. Exterior walls 33 of the webs are shaped to form glazing channels 48, and a glazing bead is applied to each channel in order to seal the array 12 to the border frame 20. The exterior walls 33 meet bottom walls 37 of the webs, and screw holes 38 extend downwardly from the bottom walls 37. Screws (not shown) fit into the screw holes 38 to attach abutting sections of the border frame 20 together at the outer corners. The screws holes 38 have triangular shaped lead channels 39, for easier positioning of the screws in the holes. Further, the lead channels serve also to reduce the weight of the border frame 20.

The legs 24 extend outwardly from the bottom walls 37 of the webs 34. The legs 24 are spaced apart by the width of a receiving portion 46 of a gasket 44 that is, in turn, received by the window frame 16. Alternatively, the gasket 44 may be integrated into the window frame 16. For ease of understanding, the drawing does not depict the various interior strengthening walls of the gasket or the window frame 16.

The free ends 24*b* of the legs 24 are secured to the receiving portion 46 of the gasket 44 using, for example, a conventional dry or wet glazing method. A snap-in glazing bead,47 holds the legs 24 in place within the gasket 44. One end 47*a* of the glazing bead is received in a depression 49 in the gasket, while the opposite end 47*b* of the bead presses against one of the legs 24, to hold the frame against a stop 45. As appropriate, sealant or glazing tape is used between the stop 45 and the legs 24.

The configuration 21 of the border frame may be constructed in aluminum, and include an open-ended recess 42 that operates as a thermal break between the interior and exterior of the frame 20. When the frame is constructed, it includes a bridge 41, as depicted in FIG. 3. A non-conducting resin is injected into the recess 42, and the bridge 41 is then severed after the resin hardens. The side walls 43 of the recess 42 are shaped to include locking detents 43*a* and 43*b*. The resin flows into the locking detents, and hardens to connect and interlock the interior and exterior of the border frame. The resin thus replaces the bridge 41. Unlike the bridge, however, the resin does not allow thermal conduction between the exterior and interior of the border frame 20. As desired, the separation between the two legs 24 may also be filled with a thermally non-conducting material, such as foam.

Figure 4:
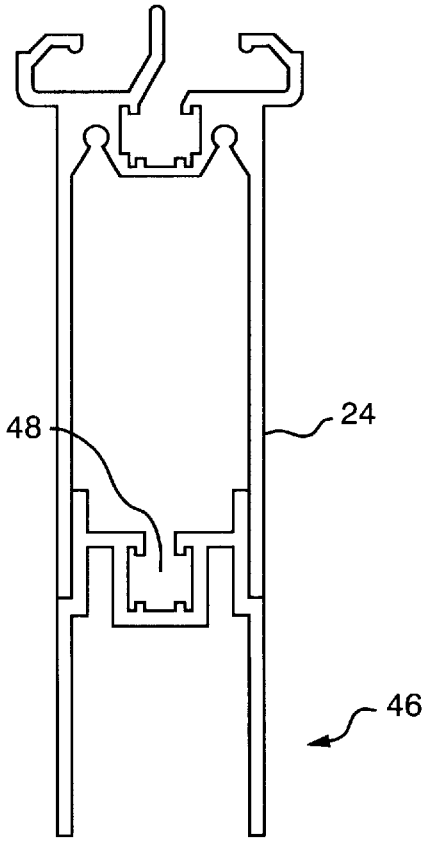
FIG. 4 depicts an extension for use with the system of FIG. 2.

Referring now to FIG. 4, an extension 66 may be attached between the legs 24, as appropriate, to further extend the width or height of the border frame 20. The ends of the inner walls of the legs 24 may be serrated to receive serrated ends of the legs 67 of the extension 66. A recess 68 that is identical to the recess 42 discussed above with reference to FIGS. 2 and 3 is included in the extension, to provide a thermal break.

Figure 5:
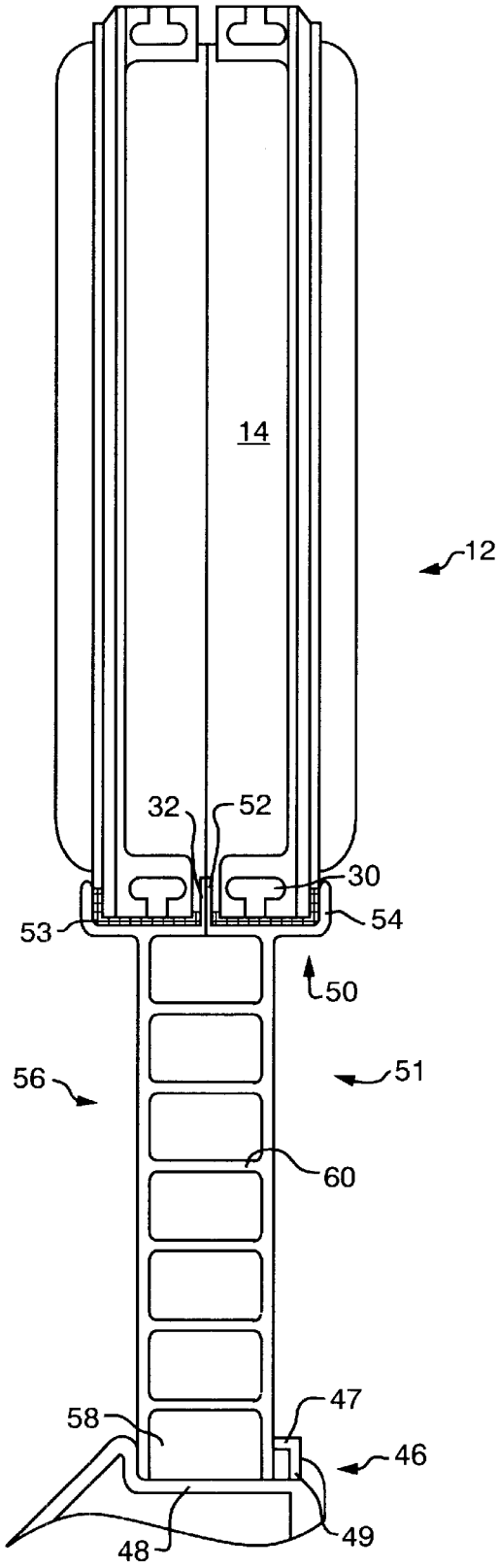
FIG. 5 is a side cut-away of an alternative configuration of the border frame depicted in FIG. 1.

FIG. 5 is a cut-away view through line A—A of an alternative configuration 51 of the border frame 20. This configuration, which may be made of extruded vinyl, includes a first end 50 that is shaped to receive the channels 30 of the block 14. A body 56, which includes two legs 54, extends outwardly from the end 50 and is cut to desired lengths for the top, bottom and side sections of the border frame. For added strength, the body 56 includes spaced, integral cross bars 60.

The first end 50 includes an alignment projection 52 that fits in the gap 32 between the channels 30 on the block. Upwardly extending walls 74 receive the exterior walls of the channels 30, an adhesive 53 is used to seal the channels to the frame. Clips (not shown) may then be used, as appropriate, to secure the array 12 to the border frame 20, as discussed above. Further, a glazing bead may be applied to seal the array 12 to the border frame 20.

Figure 6:
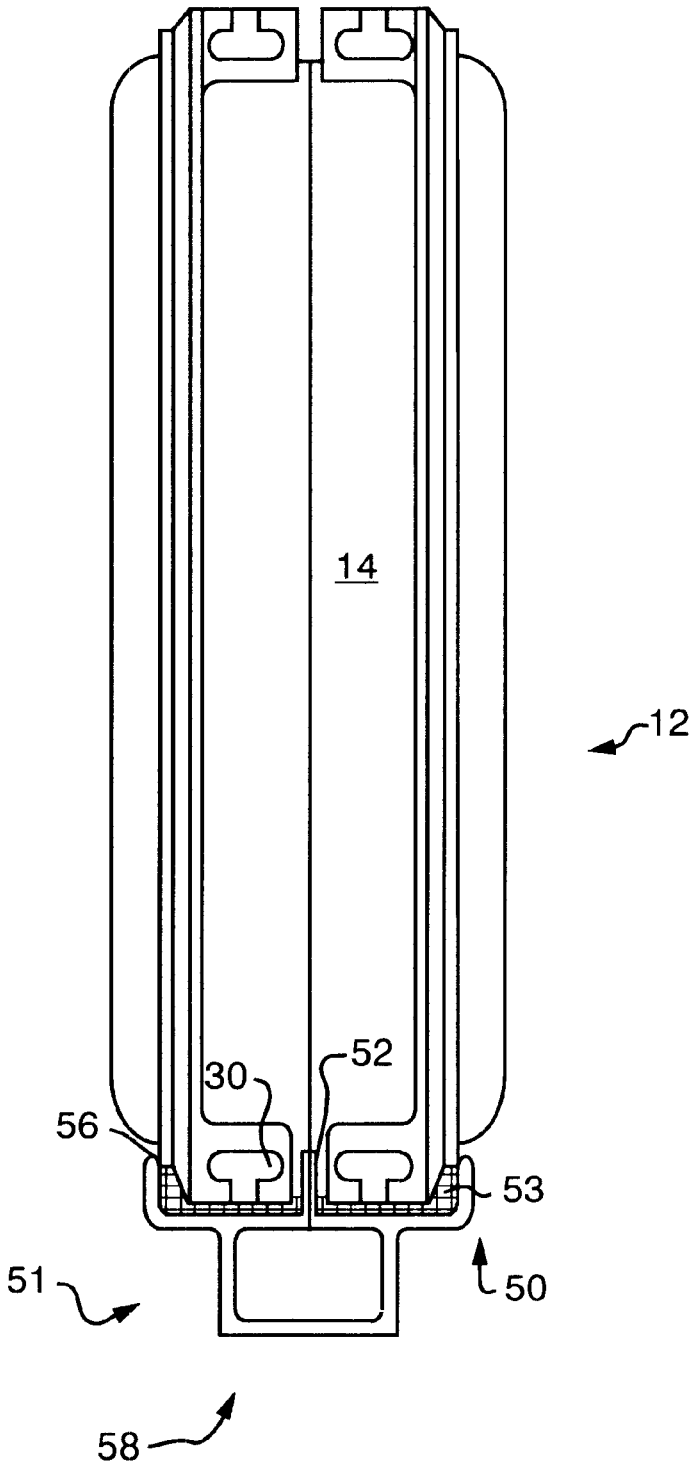
FIG. 6 depicts an alternative to the configuration shown in FIG. 5.

A second end 58 of the body 56 is received in the receiving portion 46 of the gasket 44. As discussed above with reference to FIG. 2, a glazing bead 47 holds the end 58 in place against the stop 45. As depicted in FIG. 6 the end 58 may be open or closed, depending on how the legs 54 are cut and/or extruded.

Figure 7:
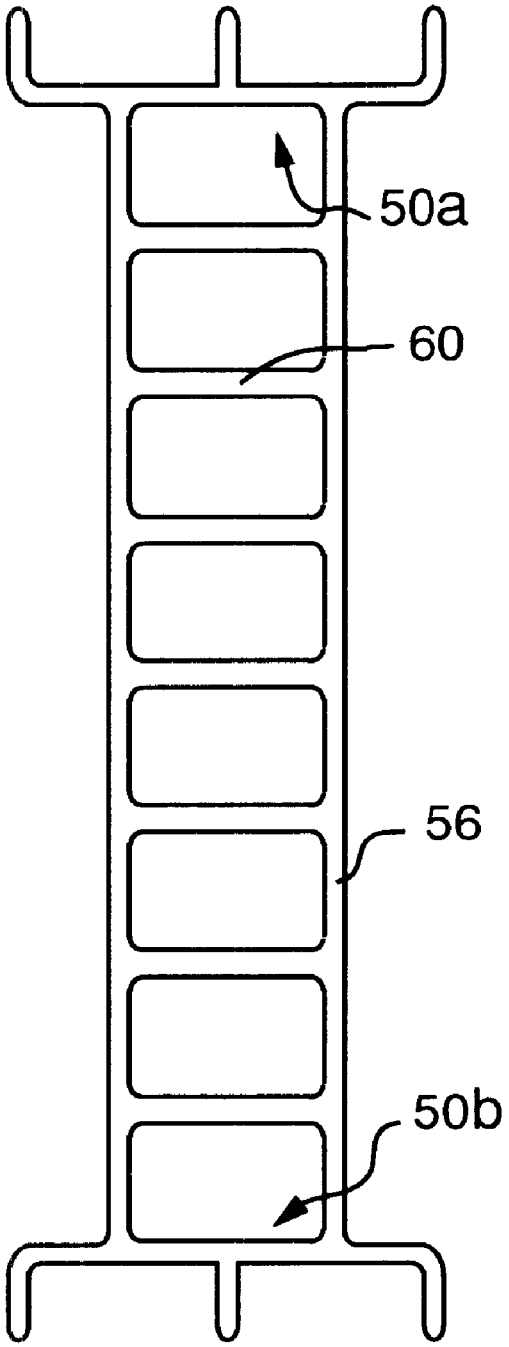
FIG. 7 depicts a section of the border frame of FIG. 5 before assembly.

Referring now to FIG. 7, the sections of border frame 20 may be extruded with identical ends 50*a* and 50*b*, which are each shaped to mate with the array 12. The body 56 between the two ends 50*a* and 50*b* is then cut to a desired length, as discussed above, and one of the ends 50*a* or 50*b* is thus removed. The end that is cut off and the portion of the body that is attached thereto may then be used in another border frame. The amount of wasted extruded material is thus minimized, even if the cut body 56 must be further shortened for the alternative use.

Figure 8:
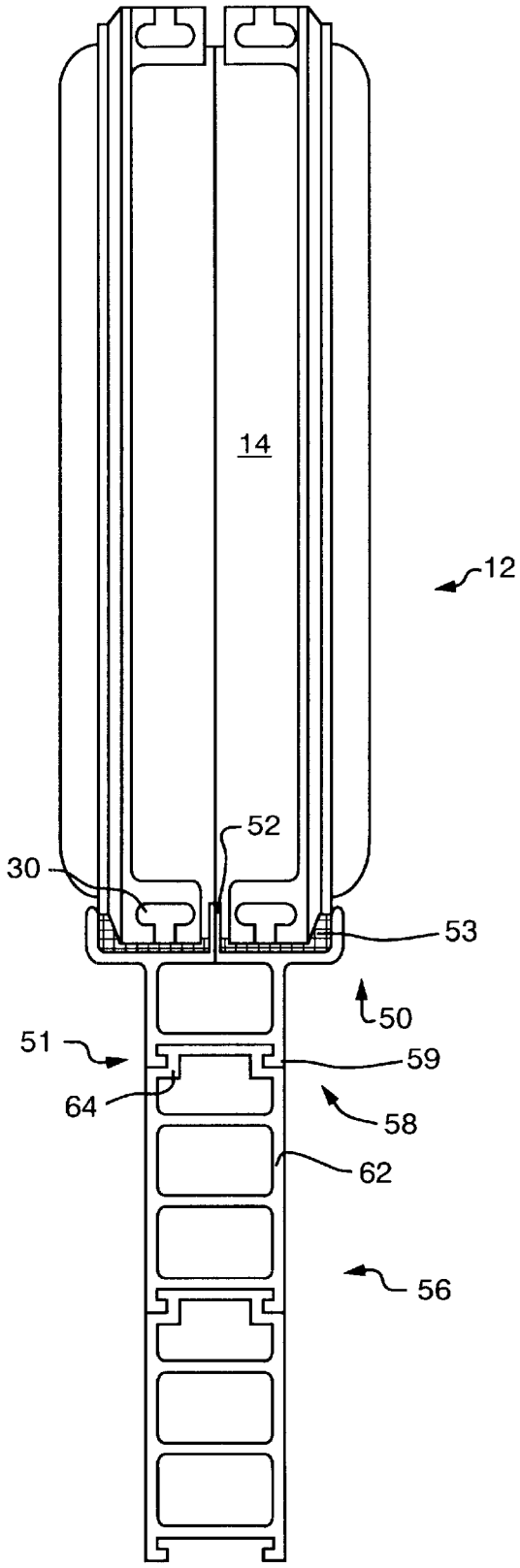
FIG. 8 depicts an alternative to the configuration shown in FIG. 6.

Referring now to FIG. 8, the end 58 may be cut or extruded to include two inwardly directed detents 59. The detents 59, which strengthen the free end 58, may also be used to grip a frame extension 62. The extension 62 essentially clips between the detents 59, to provide a longer body 56, as needed. To secure the body and the extension together, sealant may be applied between the detents 59 and the corners 64 of the extension 62 that are shaped to mate with the detents.

The outer corners (not shown) of the border frame 20 are angularly cut to form miter joints. In the configuration of FIG. 5, the body 56 of the side section of the border frame is cut to align with the angularly cut body of, for example, the bottom section of the border frame, such that the respective cross bars 60 mate at the miter joint. The border frame 20 may have heat-welded corners, and the corresponding crossbars 60 are thus welded together to from a structurally strong frame. Alternatively, the corners of the border frame 20 may be fastened mechanically, as with the screws discussed above.

What is claimed is:

1. A block window system for installation in a window frame with height and width dimensions, the block window system including:

an array of blocks with top, bottom and side walls, the array having dimensions that are smaller in one or both of height and width than the corresponding dimensions of the window frame; and a border frame with top, bottom and side sections, the top and bottom sections of the border frame each including a first end that mates with the corresponding wall of the array and a variable-dimension body to extend the wall to a desired height, and the side sections of the border frame each including a first end that mates with the corresponding wall of the array and a variable-dimension body to extend the wall to a desired width, the desired height and width conforming to the corresponding dimensions of the window frame.

2. The window system of claim 1 wherein the window frame has top, bottom and side sections, and the border frame sections each further include a second end that connects to the corresponding section of the window frame, to position the array of blocks within the window frame.

3. The block window system of claim 1 wherein:

the walls of the array each include outwardly directed connecting means; and the first end of the border frame section includes positioning means that interconnect with the connecting means and position the array within the border frame.

4. The block window system of claim 3 wherein:

the connecting means includes channels that are separated by a gap, and the positioning means includes a projection that fits into the gap.

5. The block window system of claim 2 further including:

a gasket that connects to the window frame and provides a receiving section that receives the second end of the border frame; and the second end of the border frame section mates with the receiving portion of the gasket.

6. The block window system of claim 5 wherein the body of each border frame section includes a first leg and a second leg that are separated by a distance that corresponds to the width of the receiving portion of the gasket, the lengths of the first and second legs corresponding to the desired height or width of the border frame, wherein the legs extend between the walls of the array and the window frame.

7. The block window system of claim 4 wherein the first end of the border frame section further includes a plurality of webs that mate with the channels, the webs being shaped to provide a glazing channel between the array and the border frame.

8. The block window system of claim 7 wherein the first end of the border frame section includes a thermal break between adjacent webs.

9. The block window system of claim 8 wherein the thermal break in the first end of the border frame is filled with a material that provides a non-conducting physical connection across the thermal break.

10. The block window system of claim 3 wherein the first end of the border frame section further includes a bottom wall with upwardly extending walls for receiving the connecting means.

11. The block window system of claim 10 wherein the body of the border frame further includes legs that extend from the first end.

12. The block window system of claim 11 wherein the body of the border frame further includes one or more spaced cross bars that extend between the legs.

13. The block window system of claim 2 further including one or more extensions that interconnect as part of the body of the border frame.

14. The block window system of claim 13 wherein the body of the border frame includes legs and the one or more extensions attach to the legs.

15. The block window system of claim 14 wherein the legs of the body include gripping means for gripping the extension.

16. The block window system of claim 15 wherein the gripping means is a set of detents.

17. The block window system of claim 15 wherein the gripping means is serrations at the ends of the legs.

18. A block window system including:

a window frame with top, bottom and side sections, the window frame having height and width dimensions;

an array of blocks with top, bottom and side walls, and the walls of the array each including outwardly directed connecting means, the array of blocks having one or both of height and width dimensions that are smaller than the corresponding dimensions of the window frame; and a border frame with top, bottom and side sections, the top and bottom sections of the border frame each including a first end that mates with the corresponding wall of the array and a variable-dimension body that extends from the first end and forms a second end that mates with the corresponding sections of the window frame.

19. The block window system of claim 18 wherein:

the walls of the array each include outwardly directed connecting means that includes a gap; and the first end of the border frame section includes an outwardly projecting positioning means that interconnects with the gap in the connecting means and positions the array within the border frame.

20. The block window system of claim 19 further including a gasket that connects to the window frame and provides a receiving section that receives the body of the border frame.

21. The block window system of claim 20 wherein the body of each border frame section includes a first leg and a second leg that are separated by a distance that corresponds to the width of the receiving portion of the gasket, the lengths of the first and second legs corresponding to the desired height or width of the frame, wherein the legs extend between the walls of the array and the window frame.

22. The block window system of claim 21 wherein the first end of the border frame section includes:

a plurality of webs that mate with the channels, the webs being shaped to provide a glazing channel between the array and the border frame; and a thermal break between adjacent webs.

23. The block window system of claim 22 wherein the thermal break in the first end of the border frame is filled with a material that provides a non-conducting physical connection across the thermal break.

24. The block window system of claim 21 wherein the first end of the border frame section further includes a bottom wall with upwardly extending walls for receiving the connecting means.

25. The block window system of claim 24 wherein the body of the border frame further includes one or more spaced cross bars that extend between the legs.

* * * * *